US007354028B1

(12) United States Patent
Kacy

(10) Patent No.: US 7,354,028 B1
(45) Date of Patent: Apr. 8, 2008

(54) METHOD FOR CONTROLLING APPLICATION OF BRAKES IN SINGLE DRUM HOIST SYSTEMS

(75) Inventor: Klaus Kacy, Westbank (CA)

(73) Assignee: ABB Inc., St-Laurent, Quebec (CA)

( * ) Notice: Subject to any disclaimer, the term of this patent is extended or adjusted under 35 U.S.C. 154(b) by 0 days.

(21) Appl. No.: 11/525,955

(22) Filed: Sep. 25, 2006

(51) Int. Cl.
*B66D 1/48* (2006.01)

(52) U.S. Cl. ..... 254/267; 254/277

(58) Field of Classification Search ..... 254/267, 254/274, 275, 276, 278, 277
See application file for complete search history.

(56) References Cited

U.S. PATENT DOCUMENTS 3,693,939 A * 9/1972 Buckson ..... 254/268
4,953,053 A * 8/1990 Pratt ..... 361/31
5,531,294 A * 7/1996 Burton et al. ..... 187/292
6,241,462 B1 * 6/2001 Wannasuphoprasit et al. ..... 414/800
6,269,635 B1 * 8/2001 Zuehlke ..... 60/368
6,527,130 B2 * 3/2003 Ruddy ..... 212/278
7,080,824 B1 * 7/2006 George et al. ..... 254/267
2002/0144968 A1 * 10/2002 Ruddy ..... 212/278
2003/0107029 A1 * 6/2003 Hanson et al. ..... 254/362
2005/0098768 A1 * 5/2005 Malek et al. ..... 254/267
2005/0114001 A1 * 5/2005 Newman ..... 701/50

* cited by examiner

*Primary Examiner*—Emmanuel M Marcelo
(74) *Attorney, Agent, or Firm*—Ogilvy Renault LLP

(57) ABSTRACT

A method of damping the oscillations during an emergency stop of an ascending single drum hoist system in a shaft having a conveyance, the mechanical brakes applying a braking force to the drum and the drum rotating in a first direction having a speed, comprising applying a first brake force when the drum speed reaches close to zero enabling the drum to roll back in an opposite direction to the first direction by a force generated from a first conveyance downward swing, and controlling the brake force during the first conveyance downward swing to dissipate the energy of the swing.

19 Claims, 2 Drawing Sheets

METHOD FOR CONTROLLING APPLICATION OF BRAKES IN SINGLE DRUM HOIST SYSTEMS

FIELD OF THE INVENTION

The present invention generally relates to a method suited for controlling the application of brakes during emergency stop of a single drum mine hoist system.

BACKGROUND ART

The efficiency of an underground mine and the safety of mine personnel are dependent upon the operation of the hoist. Therefore, very high standards exit for the design, construction and operation of mine hoists.

In the case of a single drum mine hoist with one conveyance used in very deep shafts in the order of 7000 ft, an electrical drive system is used for controlling the speed and a mechanical braking system is used for stopping the hoist in an emergency situation or for holding the hoist in stationary position after finishing a hoisting cycle. The stopping by the mechanical braking system in an emergency situation, referred to as an emergency stop, is initiated automatically in a case of drive failure or when a protective system detects abnormal conditions. An emergency stop can also be initiated manually by an operator of the hoist. Generally, the electrical motor must be disconnected during emergency braking.

Application of mechanical brakes during emergency stop results in deceleration of the hoist. For safety reasons, the deceleration during emergency stop must not be too small or too large. A too small deceleration results in long distances traveled before stopping, which in some cases can lead to the conveyance crashing into a shaft end. A too high deceleration subjects the people in the conveyance to excessive dynamic forces.

Due to the fact that the conveyance has a mass and is suspended on a rope, which has certain flexibility, the deceleration thereof during emergency braking results in conveyance oscillations or otherwise called bouncing. These oscillations are generated by dynamic forces developed due to speed change during emergency stop. The presence of these oscillations is undesirable as the oscillations increase the forces that the people in the conveyance are subjected to and also increase the stress in the hoist rope thereby reducing its lifetime.

Thus, the development of ways to reduce the conveyance oscillations during the hoisting cycle, and particularly during emergency stop, so as to comply with safety regulations has become imperative. A presently known controlled emergency braking method is used to provide appropriate deceleration forces so as to reduce the amplitude of the conveyance oscillations in mine hoist systems. In this method, the braking system operates with speed feedback and regulates the brake force in order to obtain proper deceleration.

An example of this controlled emergency braking method is shown in the graph of FIG. 1. The brake force is identified by curve B. The speed of hoist drum is identified by curve S, and the rope tension above the conveyance is identified by curve T. From FIG. 1, it can be seen that in the initial deceleration phase during emergency stop of a single drum mine hoist system moving in the down direction, the brake force B is increased gradually before the desired deceleration is obtained and then, in the final stage is reduced gradually. Such a control method creates an S-shaped speed curve S with the rope tension T exhibiting gradual tension changes. Notably, if the speed curve S was not S-shaped, but had a drastic acceleration/deceleration change, then the rope tension changes would not be gradual but rather step like. Hence, such rapid rope tension T changes would result in much more pronounced conveyance oscillations.

Now referring to FIG. 2, a graphical representation of emergency braking of a single drum mine hoist moving in the up direction of a shaft is shown. When moving upwards, the force of gravity plays a major part in slowing down a conveyance. In order to avoid an excessive deceleration value, the brake force B applied by the braking system must be very small. Consequently, an insignificant brake force B does not have any practical influence on the speed S of the hoist drum. The speed S curve shape is determined by the gravity force and inertia of the system. Since gravity itself creates the major downward force, the speed curve S does not have an S-shape but rather undergoes drastic deceleration changes. This can clear be seen in FIG. 2 at time 0 secs. when the electrical motor powering the hoist drum is suddenly stopped and at time 4.4 secs. when the hoist drum comes to a full stop rapidly.

Therefore, unlike in the example of FIG. 1, where the speed curve S demonstrates gradual changes, in the present case at the moment the hoist drum stops, there is a rapid change of deceleration from a value determined by the gravity force to zero. This results in rapid change in rope tension T thereby creating excessive dynamic forces.

Notably, FIG. 2 has been simplified to facilitate understanding. In reality, the change in rope tension T is not a step function as shown at 0 secs., largely due to the flexibility of the rope, but has a very fast rate of change which is much faster than in the case where the speed curve S undergoes gradual changes. Rapid, significant change of rope tension generates significant, undesirable conveyance oscillations. The significant rope oscillations caused when the hoist drum stops are clearly illustrated from 4.3 secs. onwards in FIG. 2.

Therefore, it can be seen that during emergency stop of a single drum hoist system moving in the up direction, the resulting conveyance oscillations are pronounced. There exists a need for a method of braking during emergency stop that reduces conveyance oscillations generated.

SUMMARY OF THE INVENTION

It is therefore an aim of the present invention to provide a method of controlling the brake application during emergency stop of a single drum hoist system moving upwardly to reduce conveyance oscillations generated after hoist stop.

In one aspect, the present invention provides a method of controlling the application of mechanical brakes during a stop of a single drum hoist system having a conveyance moving upwardly in a shaft, the mechanical brakes applying a braking force to the drum and the drum rotating in a first direction having a speed, comprising the steps of determining a static load unbalance of the hoist system just prior to stop, applying a first limited braking force when the drum speed is close to zero, the first limited braking force being determined as a function of the static load unbalance of the hoist system, and allowing the drum to roll-back opposite the first direction as the conveyance bounces downwards.

In another aspect, the present invention provides a method of damping the oscillations during an emergency stop of an ascending single drum hoist system in a shaft having a conveyance, the mechanical brakes applying a braking force to the drum and the drum rotating in a first direction having a speed, comprising applying a first brake force when the drum speed reaches close to zero enabling the drum to roll back in an opposite direction to the first direction by a force generated from a first conveyance downward swing, and controlling the brake force during the first conveyance downward swing to dissipate the energy of the swing.

Further details of these and other aspects of the present invention will be apparent from the detailed description and figures included below.

BRIEF DESCRIPTION OF THE DRAWINGS

Reference will now be made to the accompanying drawings, showing by way of illustration a preferred embodiment thereof, and in which.

DESCRIPTION OF THE PREFERRED EMBODIMENTS

Figure 3:
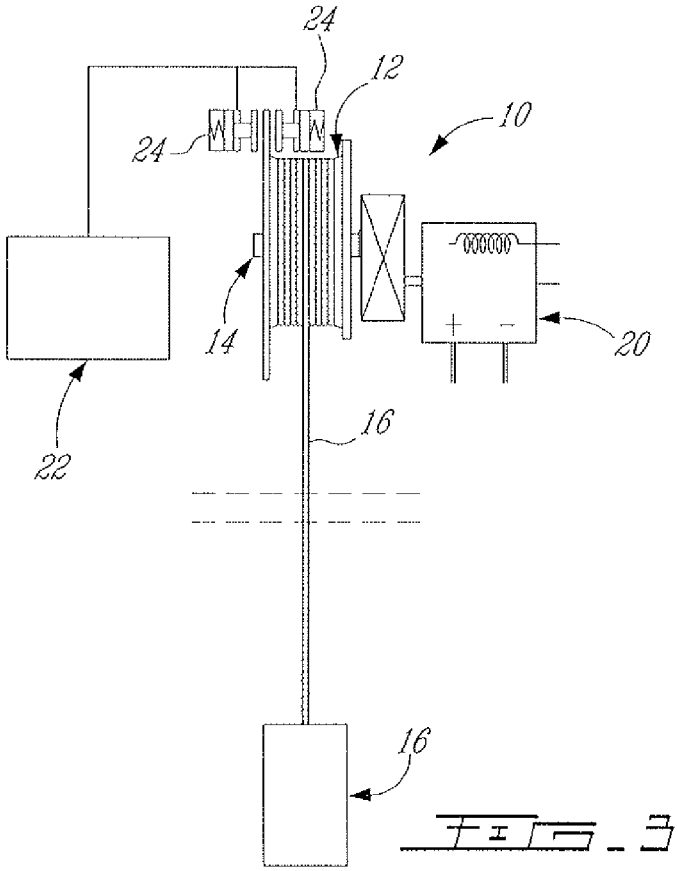
FIG. 3 is a schematic view of a single drum hoist system.

Referring to FIG. 3, a simplified embodiment of a hoist system 10 is shown. The hoist system 10 comprises a single drum 12 coupled to a shaft 14 for coiling and uncoiling a rope 16 thereabout. The hoist system 10 further comprises a cage or conveyance 18 that is attached to one end of the rope 16 for being pulled up and down a deep shaft (not shown). The other end of the rope 16 is attached to the drum 12. The drum 12 is controlled by an electrical motor 20 and a brake control system 22 which includes mechanical brakes 24.

Under normal operating conditions the electric motor 20 runs the drum 12, causing it to rotate about the shaft 14 in the clockwise or counter-clockwise direction. When an emergency stop is initiated, the electrical motor 20 providing electrical torque is disconnected and the mechanical brakes 24 are applied.

Particularly, when the emergency stop is initiated during ascent the application of the brakes 24 is controlled in accordance with a method of the present invention. During emergency stop with the conveyance moving up, the speed reduction is done mainly by the force of gravity.

Figure 4:
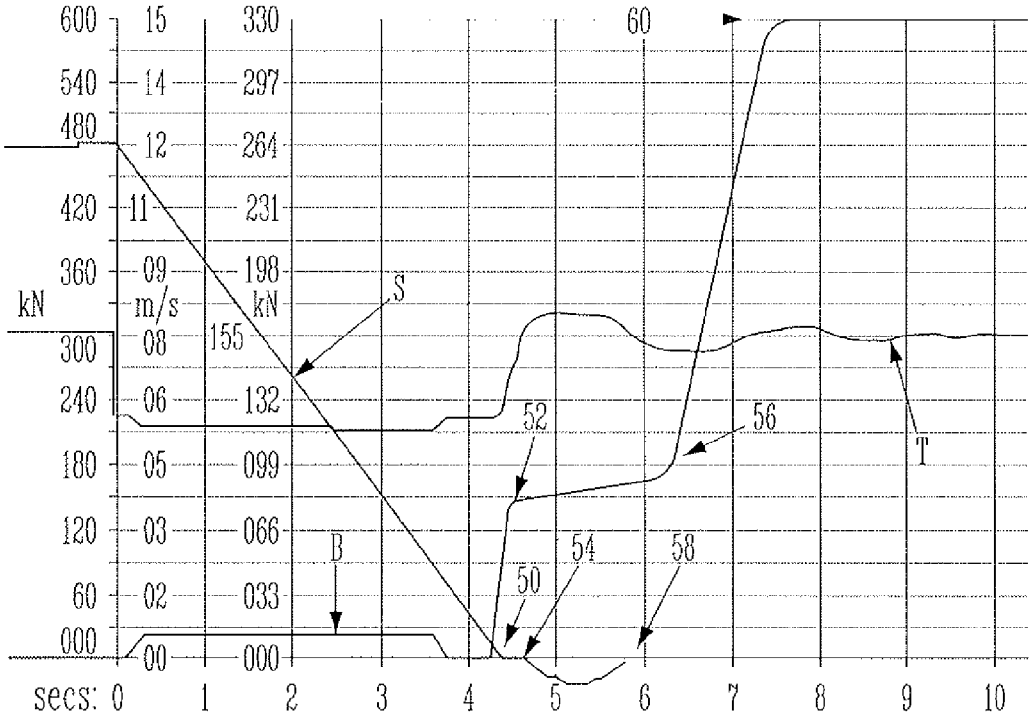
FIG. 4 is a graphical representation of brake torque and hoist drum speed of a hoist system during emergency stop with a conveyance moving up in accordance with a particular embodiment of the present invention.

Referring to FIG. 4, a graph illustrating an example of brake force B [kN] and hoist drum speed S [m/s] calculated as the tangential speed of the rope 16 of the hoist system 10 during emergency stop over a period of 10 seconds, with conveyance 18 moving up, in accordance with a particular embodiment of the method of brake control of the present invention.

In order to avoid excessive deceleration which causes the people in the conveyance 18 to loose weight, the initial brake force B applied is very small, i.e. close to zero as can be seen in FIG. 4. The hoist drum speed S will decrease linearly, largely due to the force of gravity. When at point 50, corresponding to instant t=4.5 secs. in this particular embodiment, the hoist drum speed S approximately reaches zero, the brake force B is increased to a first limited value shown at point 52. In theory, the brake force B is increased instantaneously as a step function; however, in practice the increase in brake force B is generated by a build up of torque that requires at least a fraction of a second to upsurge.

The first limited value of the brake force B is determined by the actual suspended static load, set as a linear function thereof. The first limited value of the brake force B allows the drum 12 to slowly slip during the first bounce down of the conveyance and begin rolling back in the opposite direction (i.e. conveyance downwards direction). More specifically, the first limited value is about equivalent to the suspended static load but may be slightly higher or lower by about 20%. The suspended static load of the hoist system is determined prior to initiation of emergency stop. The suspended static load can be determined at least by the following two ways. One way of determining the suspended static load is from the electrical torque, i.e. the amperage that the electrical motor 20 was delivering just prior to emergency stop such that the static load is equivalent to the amperage but in kilograms. Another way is by the position, i.e. depth in meters, of the conveyance 18 in the shaft. In the latter way, both the rope mass per meter for a given depth and the conveyance mass are added together to obtain the suspended static load.

During deceleration emergency stop on the way up, the rope tension T is reduced due to the dynamic effect created by the deceleration forces. At the instant the hoist drum speed S reaches zero, the suspended static load is no longer subjected to the deceleration forces but only to the full gravity force in the downward direction. This results in a sudden increase in rope tension T thereby causing the conveyance 18 to bounce or swing. At point 54, the increased rope tension T exceeds the brake force B and as a result the drum 12 starts rolling-back in an opposite direction causing the conveyance 18 to move downwards in the shaft. During this time, optimal conditions for dissipating the energy of the conveyance during the first bounce are preferably created by increasing, decreasing or keeping the brake force B constant. In this particular example, the first limited value of the brake force B is gradually increased linearly in time to a second limited value shown at point 56. As the hoist drum speed S increases in the negative direction and brake force B increases gradually, the peak values of the conveyance acceleration caused by the emergency stop and amplitude of the conveyance bounce are reduced.

Figure 1:
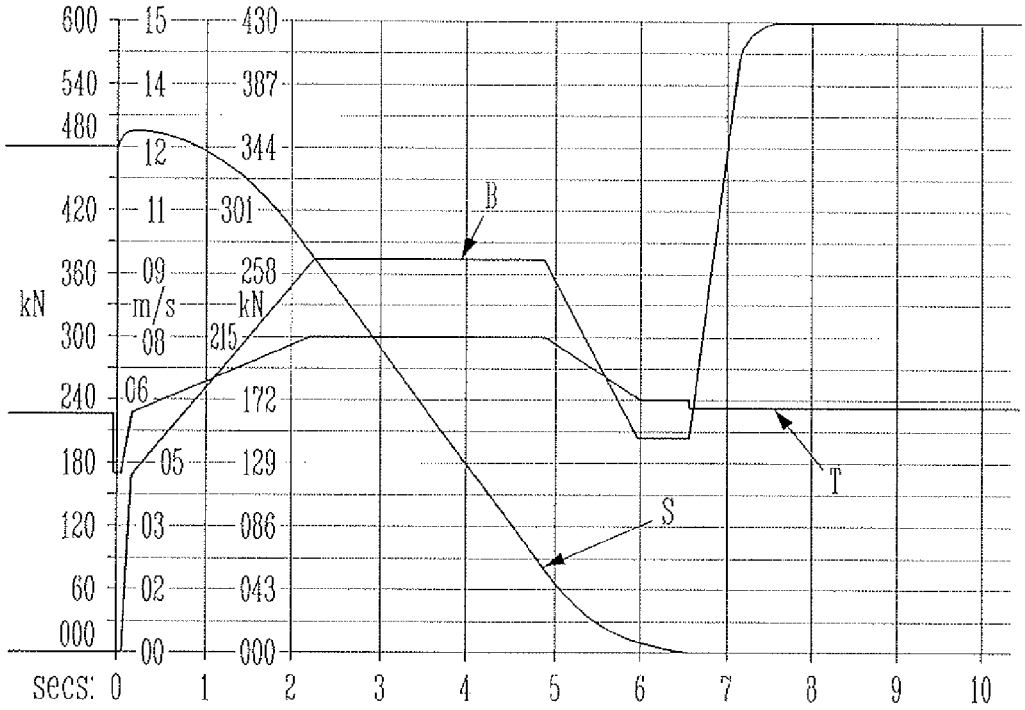
FIG. 1 (PRIOR ART)
FIG. 1 is a graphical representation of brake torque, hoist drum speed and rope tension of a single drum hoist system during emergency stop with a conveyance moving down in accordance with a controlled emergency braking method of the prior art.
Figure 2:
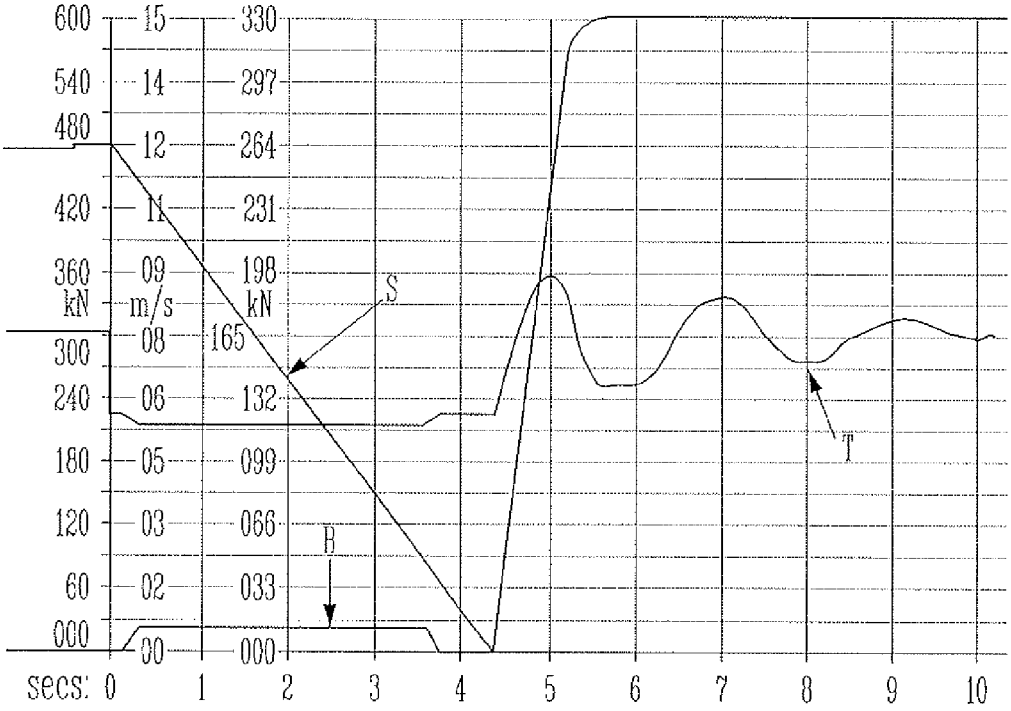
FIG. 2 (PRIOR ART)
FIG. 2 is a graphical representation of brake torque, hoist drum speed and rope tension of a single drum hoist system during emergency stop with a conveyance moving up in accordance with a controlled emergency braking method of the prior art.

Still referring to FIG. 4, at point 58 the drum 12 stops due to increased brake force B reaching the second limited value at point 56 and the reduced force from the conveyance bounce. Preferably, the second limited value is greater than the first limited value which is close to the actual suspended static load. At the instant the hoist drum speed S reaches zero for the second time, the brake force B is increased to the maximum available braking force shown at point 60 on FIG. 2, thereby providing secure hold of the hoist drum 12. The brake force B is preferably increased as a step-like function (in theory) at the moment the hoist drum speed S reaches zero. Notably, the maximum value will vary depending on the parameters of the hoist system.

Although subsequent oscillations may follow the first bounce, the dynamic forces generated thereby are generally within applicable regulations and do not require a reduction in amplitude. A substantial amount of the energy driving the oscillations is dissipated during the first bounce in the period when there is negative speed and a braking force by controlling the brake application as described herein above. In FIG. 4, the rope tension T clearly illustrates less amplified oscillations than in FIG. 2, where there is no increase in brake force B.

It should be noted the method of controlling the brakes described above does not always generate a delay between when the hoist drum speed S reaches zero and when it begins to roll-back in the opposite direction as is the case between point 50 and 54 of the example shown in FIG. 4. The presence of the delay depends on many variables including the inertia of the drum 12 and the phase of the conveyance 18 bounce. As the conveyance is already bouncing prior to when the hoist drum speed S reaches zero, a delay may be present for example if the conveyance 18 is in an upward swing phase. With respect to the inertia of the drum 12, the larger the drum, the greater the inertia forces to overcome before the drum can change direction of rotation and roll-back.

The method of brake control of the present invention is a strategy designed to reduce the severe, after-stop conveyance oscillations that occur following emergency stop on the way up in a deep shaft and with the hoist drum speed S above approximately 400 FPM (approx. 2 m/s). In a deep shaft of 7000 ft the oscillation effects are pronounced when compared to that of a shaft of 1000 ft. Of course a person skilled in the art will recognize that the method of the present invention can still be applied when a hoist drum speed S is less than the above value or the shaft is not deep; however, the method of controlling the brake application is not required as the conveyance oscillations that occur are minimal and within applicable regulations.

Furthermore, it can be seen that in the case of emergency braking of the conveyance moving in the upward direction the mechanical brakes 24 are substantially only applied close to when the hoist drum speed slows down to zero; thus, the brake torque does not influence the deceleration of the hoist drum before it stops. By introducing a controlled brake application when the hoist drum speed reaches zero, the conveyance oscillations after emergency stop are reduced. Therefore, the braking force applied by the mechanical brakes 24 in the method of the present invention is used largely to dissipate the energy of the conveyance 18 oscillations rather than to stop the hoist drum 12.

The above description is meant to be exemplary only, and one skilled in the art will recognize that changes may be made to the embodiments described without department from the scope of the invention disclosed. Still other modifications which fall within the scope of the present invention will be apparent to those skilled in the art, in light of a review of this disclosure, and such modifications are intended to fall within the appended claims.

The invention claimed is:

1. A method of controlling the application of mechanical brakes during an emergency stop of a single drum hoist system having a conveyance moving upwardly in a shaft, the mechanical brakes applying a braking force to the drum and the drum rotating in a first direction having a speed, comprising the steps of:

determining a static load unbalance of the hoist system just prior to stop;

applying a first limited braking force when the drum speed is close to zero, the first limited braking force being determined as a function of the static load unbalance of the hoist system; and allowing the drum to roll-back opposite the first direction as the conveyance bounces downwards.

2. The method of claim 1, further comprising the step of dissipating energy of the conveyance bounce by one of increasing, decreasing or keeping the braking force B constant.

3. The method of claim 2, further comprising the step of increasing the braking force gradually in a linear manner to dissipate the conveyance bounce energy.

4. The method of any one of claims 1 to 3, further comprising the step of applying a maximum available braking force greater than the first limited braking force when the drum speed returns back to zero.

5. The method of claim 1, wherein the drum prior to the stop is controlled by an electrical motor producing an electrical torque and the method further comprising the step of determining the static load unbalance from the electrical torque present prior to the initiation of the stop.

6. The method of claim 1, further comprising the step of determining the static load unbalance from a position of the conveyance in the shaft when the drum speed is close to zero.

7. The method of claim 1, wherein the first limited brake force is between about 20% greater and 20% less than the static load unbalance.

8. The method of claim 1, further comprising applying the first limited brace force as a step-like function when the drum speed reaches zero.

9. The method of claim 1, further comprising applying the maximum brake force as a step-like function when the drum speed returns to zero.

10. A method of damping the oscillations during an emergency stop of an ascending single drum hoist system in a shaft having a conveyance, the mechanical brakes applying a braking force to the drum and the drum rotating in a first direction having a speed, comprising:

applying a first brake force when the drum speed reaches close to zero enabling the drum to roll back in an opposite direction to the first direction by a force generated from a first conveyance downward swing; and controlling the brake force during the first conveyance downward swing to dissipate the energy of the swing.

11. The method of claim 10, further comprising the step of determining a static load unbalance of the hoist system just prior to initiation of the stop.

12. The method of claim 1, wherein the first brake force is determined as a function of the static load unbalance of the hoist system.

13. The method of claim 12, wherein the first brake force is between 20% greater and 20% less than the static load unbalance.

14. The method of claim 13, wherein the drum prior to the stop is controlled by an electrical motor producing an electrical torque and the method further comprising the step of determining the static load unbalance from the electrical torque present prior to the initiation of the stop.

15. The method of claim 13, further comprising the step of determining the static load unbalance from a position of the conveyance in the shaft when the drum speed is close to zero.

16. The method of any one of claims 10 to 15, further comprising applying the first brake force as a step-like function when the drum speed reaches zero.

17. The method of claim 10, wherein the step of controlling the brake force further comprises dissipating energy of the conveyance bounce by one of increasing, decreasing or keeping the braking force B constant.

18. The method of claim 10, further comprising the step of applying a maximum available braking force greater than the first brake force following dissipation of the first conveyance downward swing.

19. The method of claim 18, further comprising applying the maximum available brake force as a step-like function when the drum speed returns to zero following roll-back.

* * * * *